United States Patent [19]

Howard

[11] 4,292,775

[45] Oct. 6, 1981

[54] BUILDING WALL STRUCTURE

[76] Inventor: David Howard, P.O. Box 295, Alstead, N.H. 05602

[21] Appl. No.: 935,536

[22] Filed: Aug. 21, 1978

Related U.S. Application Data

[63] Continuation of Ser. No. 680,063, Apr. 26, 1976, abandoned.

[51] Int. Cl.[3] ..... E04B 5/48; E04F 17/00; E04F 13/04

[52] U.S. Cl. ..... 52/220; 52/282; 52/309.12; 52/309.17; 52/343; 52/348; 52/404; 52/405; 52/446; 52/454; 52/744

[58] Field of Search ..... 52/454, 407, 326, 327, 52/744, 220, 348, 670, 318, 342, 677, 352, 404, 414, 343, 405, 443, 282, 446, 374, 309.17, 309.12, 371, 743, 347, 406, 313

[56] References Cited

U.S. PATENT DOCUMENTS

| | | | |
|---|---|---|---|
| 1,102,883 | 7/1914 | Dawson | 52/348 |
| 1,220,915 | 3/1917 | Wells | 52/326 |
| 1,510,224 | 9/1924 | Hicks | 52/348 X |
| 1,888,841 | 11/1932 | Wentzel et al. | 52/743 X |
| 2,020,908 | 11/1935 | Scammell | 52/347 |
| 2,041,910 | 5/1936 | Ericson | 52/405 |
| 2,192,933 | 3/1940 | Saborsky | 52/404 |
| 2,414,094 | 1/1947 | Couelle | 52/348 |
| 2,780,090 | 2/1957 | Rasmussen | 52/407 X |
| 3,255,563 | 6/1966 | Sauer | 52/404 |
| 3,619,437 | 11/1971 | McDonald, Jr. | 52/407 |
| 3,772,840 | 11/1973 | Hala | 52/303 |

FOREIGN PATENT DOCUMENTS

| | | | |
|---|---|---|---|
| 910156 | 11/1962 | United Kingdom | 52/309.17 |

*Primary Examiner*—Leslie Braun
*Attorney, Agent, or Firm*—Cesari & McKenna

[57] ABSTRACT

A wall structure for enclosing a building frame comprises a wire mesh, panels of insulation, and reinforcing nailer-stringers. The mesh is secured to the outside of the frame and an insulating layer comprising, alternately, insulating panels and nailer-stringers is secured to the frame outside the wire mesh. Some of the insulating panels are vertically sectioned to accommodate electrical wires between the sections. The sections are pressed together to secure and conceal the wires. The inside surface of the wall structure is finished by applying a layer of plaster which adheres to and is reinforced by the wire mesh.

6 Claims, 2 Drawing Figures

BUILDING WALL STRUCTURE

This is a continuation of application Ser. No. 680,063 filed Apr. 26, 1976 and now abandoned.

BACKGROUND OF THE INVENTION

The present invention relates to a wall structure for insulating and enclosing a building frame. More specifically, the invention relates to a wall structure which retains electrical wiring and provides a base and reinforcement for an interior finishing layer of plaster.

Post-and-beam frame construction is a well known and popular form of home construction. Several styles of prefabricated or precut housing have been developed in recent years to take advantage of modern manufacturing techniques combining the appearance and cost advantage of post-and-beam construction.

Typically, in a post-and-beam structure a heavy wooden frame is constructed of vertical posts and horizontal beams which receive the roof and upper floor stresses and transmit them to the posts.

After the frame has been constructed, various known means may be used for enclosing and insulating the building. Insulation may be placed between the beams and siding nailed to the outside of the beams. A wire lathing as a base for plastering or wall board may be secured to the inside surface of the frame. However, this form of construction has two drawbacks. First, the insulation does not serve to keep the structural members themselves at a uniform temperature. Therefore, in cold weather, the interior side of the post is warmer than the outside and moisture migrates from the inside toward the colder outside where it condenses, flows downward and accumulates to cause rotting or to freeze and weaken the frame members. Secondly, this construction does not enable the builder to leave the beams exposed if he wishes to do so.

Accordingly, some home manufacturers attach the insulation outside of the main structural members. This construction exposes the structural members to view and insulates them from cold temperature. However, a problem inherent with this type of enclosure is that there is no convenient way to conceal wiring along the wall. Further, it does not provide a fully suitable arrangement for applying plaster to the inside of the wall.

SUMMARY OF THE INVENTION

It is an object of the invention to provide an improved wall structure for enclosing a building frame.

A further object of the invention is to provide a wall structure with an improved arrangement for an interior plaster layer.

Yet another object of the invention is to provide a wall structure which supports and conceals electrical wiring.

In accordance with the above objectives, I provide a wall structure for enclosing a building frame, the wall structure comprising, alternately, in vertical succession, panels of insulation and reinforcing stringers. A mesh attaches to the outside of the frame and the stringers and panels attach to the frame outside the mesh. Some of the panels are sectioned to receive horizontal electrical, wiring extending around the structure between the sections. The mesh provides a base and reinforcement for a finish layer of plaster on the inside surface of the wall structure.

DESCRIPTION OF THE DRAWINGS

The foregoing and other objects of the invention will be more readily understood from the following when taken in conjunction with the accompanying drawings in which.

DESCRIPTION OF THE PREFERRED EMBODIMENT

Figure 1:
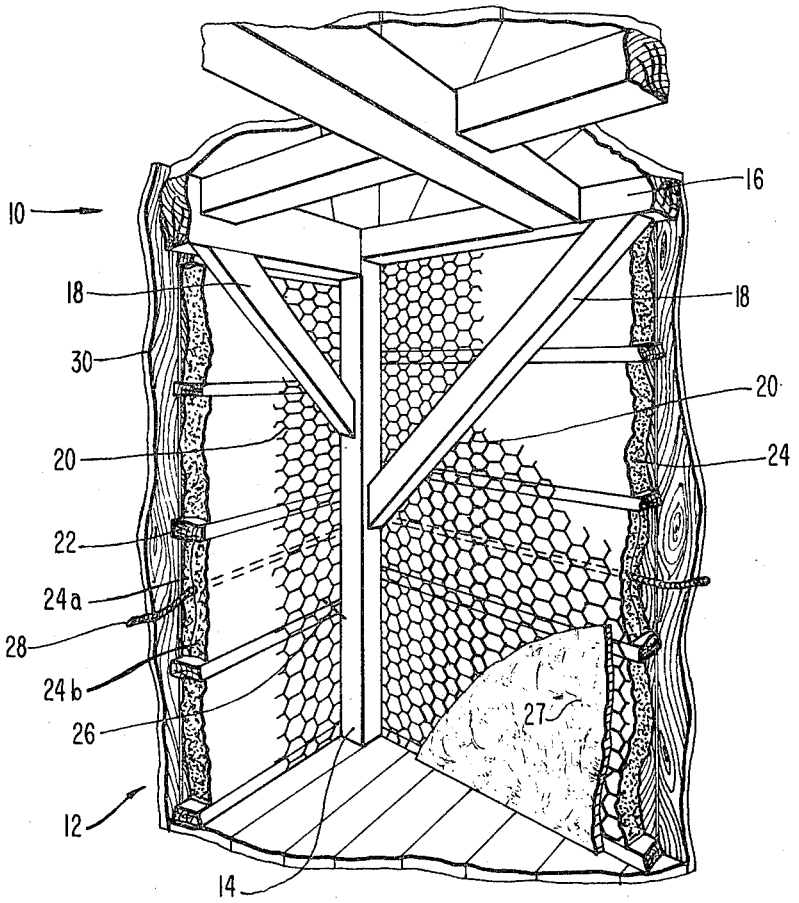
FIG. 1 is a cutaway perspective view of the wall structure of the present invention.

FIG. 1 shows generally a portion of a building frame 10 which is enclosed by a wall structure 12 in accordance with the present invention. The frame 10 includes a post 14, beams 16, and knee braces 18.

To enclose the frame 10, a mesh 20, which may be common "chicken-wire" or other wire mesh, is stapled or otherwise secured to the outside of the frame 10. Wooden stringers 22 and foam insulation panels 24 are stacked alternately outside the mesh 20. The stringers 22 may be common 2×4 lumber and the panels 24 may be rigid polystyrene foam. Nails 26 are "toe-nailed", or angled, through the stringers 22 and panels 24 into the post 14 and the other posts around the structure to secure them to the frame 10. Thus, a wall of alternating nailer-stringers 22 and insulating panels 24 is secured to the outside of the frame. The mesh 20 is stapled with staples 25 or otherwise secured at intervals to the stringers 22.

The inside surface of the wall structure 12 may be finished by applying a layer of plaster 27 which adheres to the foam panels 24 and the mesh 20 and is reinforced by the mesh 20. The mesh 20, which is customarily transported in rolls, forms an uneven, sinuous surface when unrolled. This surface is imbedded in the plaster layer 27 to provide the above mentioned reinforcement. Spacers (not shown) may be inserted between the wall structure 12 and mesh 20 to insure that the mesh is spaced from the foam panels and thus is imbedded in the plaster layer. Consequently, the mesh 20, in combination with the present wall structure 12, eliminates the need for conventional lathing, and, additionally, reinforces the plaster finish layer 27.

Figure 2:
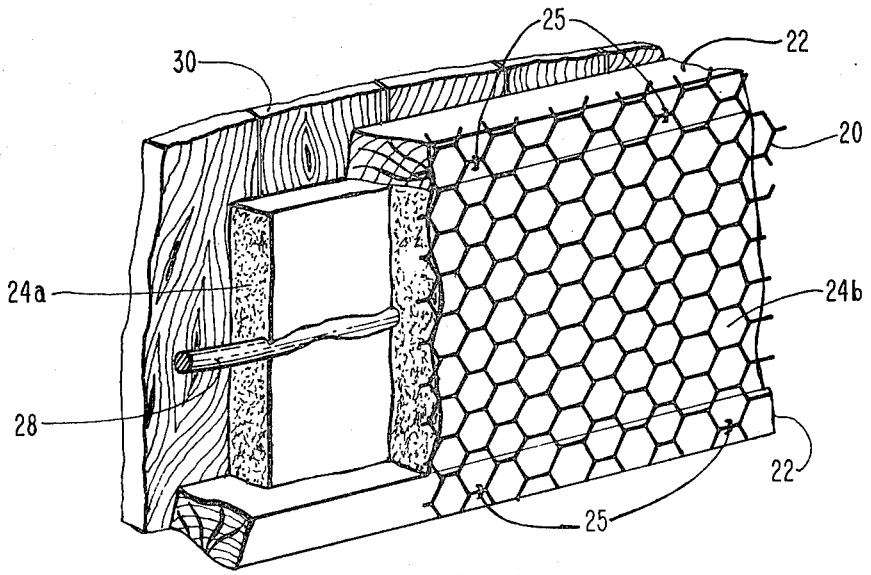
FIG. 2 is a cutaway view of a wall structure segment using a sectioned panel of insulation in accordance with the present invention.

As shown in FIGS. 1 and 2, some of the panels of insulation 24 are divided into section **24*a* and 24*b*. Electrical wires 28 for connection to various outlets are disposed between the sections 24*a* and 24*b* and the sections are pressed together to enclose the wires 28. Since the panels 24 are made of an easily deformable material, the adjacent surfaces of panels 24*a* and 24*b* deform to accommodate the wires 28. Thus, the wires 28 are quickly installed and concealed. In the event that unusually thick wires 28 are installed, a groove may be cut in one or both of the sections 24 to accommodate the wires. One highly desirable result of this construction is that the wires 28 are quickly installed around the perimeter of the frame without cutting through the vertical posts 14**. This is a distinct advantage over known wall construction.

A layer of waterproof siding 30, secures to the stringers 22, seals the outside of the wall structure and provides a decorative exterior surface.

Thus, the present wall structure fulfills the objects of the invention. It is made from inexpensive and readily available materials and is quickly constructed using only hand tools. Electrical wiring is readily concealed within the structure and its inside and outside surfaces are appropriate for finishing by plastering and siding, respectively.

It will be clear to those skilled in the art that various changes may be made from the foregoing without departing from the spirit or the scope of the invention being defined with particularity in the attached claims.

I claim:

1. A wall structure for enclosing a frame adapted to support a building, the frame including interconnected vertical and horizontal frame members and an inside surface and an outside surface, said wall structure comprising:

A. a mesh secured to the outside surface of the frame,

B. a plurality of rigid insulating panels,

C. a plurality of reinforcing stringers, said panels and stringers being arranged alternatively to form a wall outside said mesh and adjacent the outside surface of the frame, the inside surface of the frame thereby being left exposed by the wall, D. means for securing said panels and said stringers to the frame, and E. a plaster finish layer applied to said mesh between the exposed members of the frame, said plaster finish layer adhering to and being reinforced by said mesh and being supported by said mesh and said insulating panels.

2. A wall structure as defined in claim 1 wherein said insulating panels and stringers alternate in vertical succession.

3. A wall structure as defined in claim 2 wherein said insulating panels are polystyrene foam.

4. A wall structure as defined in claim 3 wherein said mesh is a wire mesh.

5. A wall structure as defined in claim 4 further comprising an exterior waterproof sheathing secured to said stringers.

6. A wall structure as defined in claim 1 wherein selected ones of said insulating panels are sectioned for receiving and retaining electrical wires between the sections, the electrical wires thereby being concealable from view.

* * * * *